United States Patent [19]

Graser

[11] Patent Number: 4,508,258

[45] Date of Patent: Apr. 2, 1985

[54] SLEEVE-STYLE BEVERAGE CARTON

[75] Inventor: Earl J. Graser, Monroe, La.

[73] Assignee: Manville Service Corporation, Denver, Colo.

[21] Appl. No.: 376,855

[22] Filed: May 10, 1982

[51] Int. Cl.[3] ..... B65D 5/46

[52] U.S. Cl. ..... 229/38; 229/40; 229/52 B; 206/427; 206/434

[58] Field of Search ..... 229/38, 17 R, 17 B, 229/528, 52 BC, 40; 206/427, 434

[56] References Cited

U.S. PATENT DOCUMENTS

| | | | |
|---|---|---|---|
| 2,931,490 | 4/1960 | McGihon | 206/427 |
| 3,894,681 | 7/1975 | Arneson et al. | 229/17 B |
| 3,904,036 | 9/1975 | Forrer | 206/427 |
| 3,933,303 | 1/1976 | Kirby, Jr. | 206/427 |
| 3,994,432 | 11/1976 | Kirby, Jr. | 229/52 B |
| 4,053,098 | 10/1977 | Baptist | 229/40 X |
| 4,331,289 | 5/1982 | Killy | 229/52 B |
| 4,364,509 | 12/1982 | Holley, Jr. et al. | 229/17 B |

*Primary Examiner*—Allan N. Shoap
*Assistant Examiner*—Bryon Gehman
*Attorney, Agent, or Firm*—John D. Lister; Timothy R. Schulte

[57] ABSTRACT

A sleeve-style beverage carton for use on a carton filling machine having traveling flight bars is disclosed. The carton may be formed in various models for use in packaging either cans or bottles and contains a novel first cut-out formed in the dust flaps of the carton. The first cut-out is sized a predetermined length to provide a cut-out area so that the dust flaps can be revolved during the filling operation to clear the traveling flight bar used in the carton filling machine. A second pair of cut-outs may be formed in the dust flaps for similar purposes. A third and fourth pair of cut-outs may be formed in the dust flaps to minimize drag in combination with the first and second pair of cut-outs on one version of the carton. A fifth and sixth pair of cut-outs may be used with one of the models shown to aid in proper alignment of the carton end panels.

2 Claims, 6 Drawing Figures

SLEEVE-STYLE BEVERAGE CARTON

BACKGROUND OF THE INVENTION

This invention relates in general to beverage cartons and in particular to a new and improved sleeve-style beverage carton for use with a carton filling machine having traveling flight bars.

In the design of carton filling machines of the type having traveling flight bars, it is known to provide a sleeve-style type package which is moved on the filling machine while it is subsequently filled through open ends of the sleeve-style carton. It is known to provide end flaps on the sleeve-style cartons which are subsequently closed after a plurality of cans are positioned within the carton.

With the advent of dust flaps being utilized with sleeve-style beverage cartons of the type before-mentioned, problems have been encountered using existing carton filling machines which could adapt to a sleeve-style carton having dust flaps positioned on the ends of the carton and immediately adjacent and glued to the end flaps.

The use of cartons with dust flaps in existing machines with traveling flight bars requires modifications in either the carton or the machine in order to accommodate the dust flaps during the filling operation. Since modifications to the filling machine become more expensive than modifications to the carton structure itself, the Applicant's new and improved carton thereby is able to be utilized on existing filling machines.

The use of dust flaps on a sleeve-style beverage carton also results in problems encountered during the closing of the ends of the carton whenever the dust flaps are first positioned inwardly into the carton opening. A frictional drag has been encountered between the dust flaps and the side flaps during the inturning operation which has been overcome by the Applicant's new and improved carton.

SUMMARY OF THE INVENTION

In order to overcome the problems inherent in the use of sleeve-style cartons with dust flaps as before-described on existing carton filling machines, there has been provided by the subject invention a new and improved sleeve-style carton for use on the before-mentioned filling machine which has improved features which obviate the problems previously mentioned.

The Applicant's sleeve-style carton improvement comprises a first pair of cut-outs formed in at least one pair of the dust flaps with the cut-outs being sized a predetermined dimension to provide a cut-out area so that the dust flaps can be revolved during the filling operation. A second pair of cut-outs may be formed in one pair of the dust flaps for the same purposes before-mentioned. A third and a fourth pair of cut-outs may be formed in pairs of the dust flaps with the first and second and third and fourth pairs of cut-outs thus formed serving to minimize the drag between the dust flaps and the one pair of side flaps whenever the dust flaps are closed on the carton after the carton has been filled. Fifth and sixth pairs of cut outs may also be added for the purposes hereinafter described.

The Applicant's improved sleeve-style carton is shown in the preferred embodiment in one form with a modification shown in another form utilizing the same basic first, second, third and fourth cut-out features of the invention.

Accordingly, it is an object and advantage of the invention to provide a new and improved sleeve-style beverage carton that may be used with existing carton filling machines having traveling flight bars with the carton containing dust flaps on the ends of the package which may be turned outwardly and inwardly at appropriate times without interfering with the necessary parts of the filling machine or without interfering with the closing of the end flaps of the package.

Another object and advantage of the invention is to provide a new and improved sleeve-style beverage carton and production blank for the carton which has improved features allowing the carton to utilize dust flaps with existing machinery and to result in less downtime of the existing machinery during closing operations of the package.

These and other objects and advantages of the invention will become apparent from a review of the drawings and from a study of the specification hereinafter following which describes the preferred embodiment of the invention by way of illustration only.

DESCRIPTION OF THE PREFERRED EMBODIMENT

Figure 1:
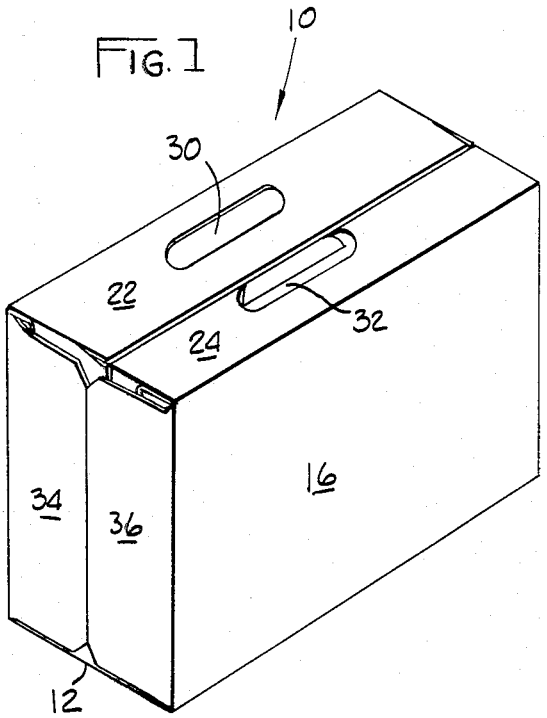
FIG. 1 is a perspective view of the preferred embodiment of the Applicant's invention.

Referring now to the drawings in general and in particular to FIG. 1 of the drawing, there is shown the Applicant's new and improved sleeve-style beverage carton generally by the numeral 10 which comprises a bottom panel 12 and a pair of side panels 14 and 16 hingedly attached to the bottom panel 12 by means of the score lines 18 and 20.

A top panel is hingedly connected to opposite sides of the side panels 14 and 16 to form the completed sleeve of the sleeve-style carton 10. The top panel in the preferred embodiment shown may be formed in a two-piece construction comprising two separate top panels 22 and 24 which are hingedly attached to their respective side panels by means of the score lines 26 and 28. The top panel of the carton has formed therein handle means for lifting the carton. The handle means would comprise a pair of handle openings 30 and 32 formed in the respective top panels 22 and 24.

Figure 5:
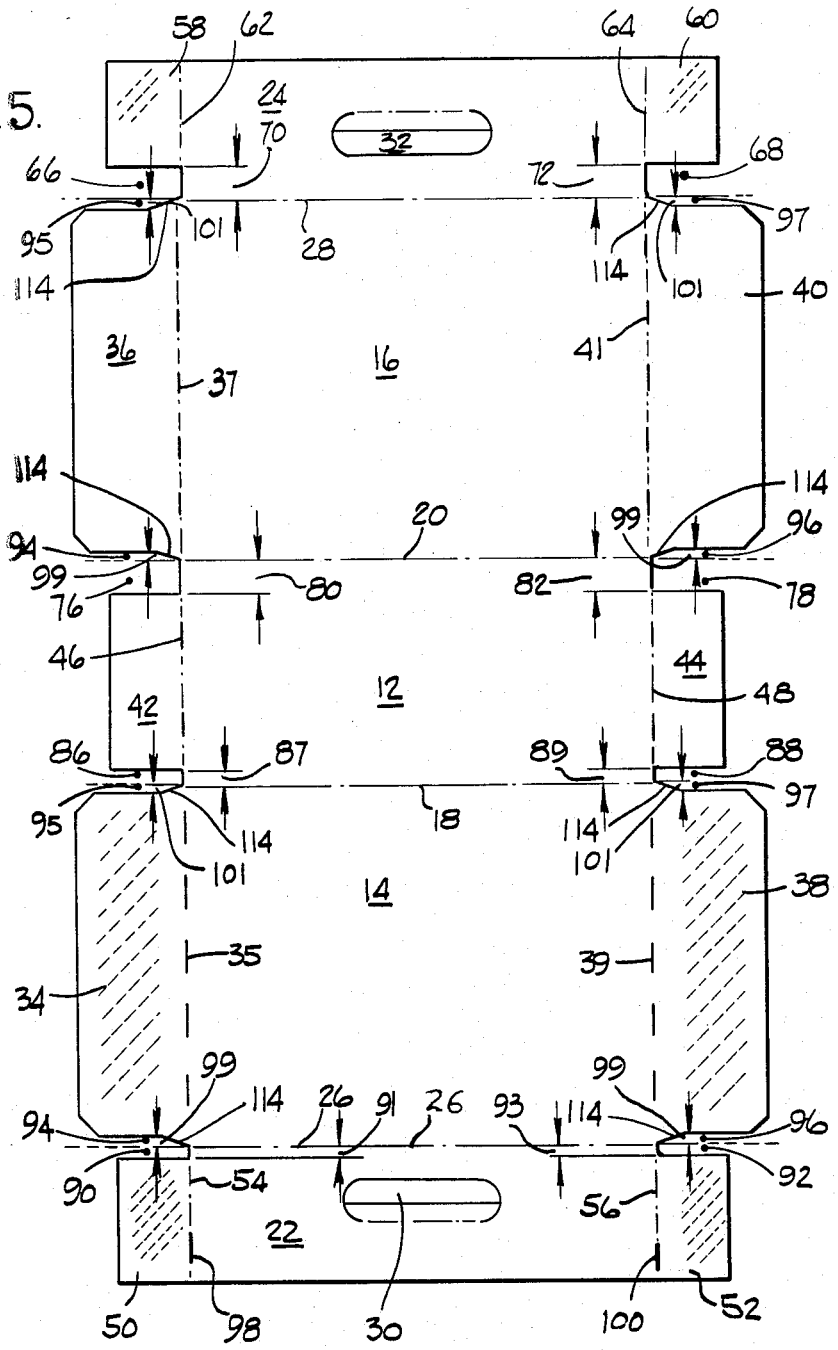
FIG. 5 is a plan view of the production blank for the package shown in FIG. 1 of the drawings.

A pair of end panels 34 and 36 are hingedly attached to opposite sides of the side panels 14 and 16 on one side of the carton by means of the score lines 35 and 37 as shown in FIG. 5. A pair of end panels 38 and 40 are hingedly attached to opposite sides of the side panels 14 and 16 on the other end of the carton by means of the score lines 39 and 41 which is shown more clearly in FIG. 5 of the drawings.

Referring now to FIG. 5 of the drawing, there will be described more fully the remaining features of the carton 10 shown in FIG. 1 of the drawings. A pair of bottom dust flaps 42 and 44 are hingedly connected to opposite sides of the bottom panel 12 by means of the score lines 46 and 48. In a similar manner, a pair of top panel dust flaps 50 and 52 are hingedly connected to the top panel 22 by means of the score lines 54 and 56. In a similar manner, a pair of top panel dust flaps 58 and 60 are hingedly connected to the top panel 24 by means of the score lines 62 and 64.

A first cut-out 66 and 68 is formed in at least one pair of the dust flaps 58 and 60 for the purposes to be described more fully hereinafter. The first cut-outs 66 and 68 are sized a predetermined dimension shown by the numeral 70 and 72 so as to provide a cut-out area that will allow the dust flaps 58 and 60 to be revolved during the filling operation on the filling machine in order that the dust flaps can clear necessary parts the traveling flight bar 74 of the filling machine.

The sleeve-style beverage carton shown in FIG. 5 of the drawing a second pair of cut-outs 76 and 78 formed in the dust flaps 42 and 44. The second cut-outs 76 and 78 are sized a predetermined dimension shown by the numerals 80 and 82 which will provide a cut-out area that will allow the dust flaps 42 and 44 to be revolved during the filling operation in order to clear necessary parts of the filling machine.

The sleeve-style beverage carton production blank shown in FIG. 5 may also have formed therein a third pair of cut-outs 86 and 88 which are formed on the pair of dust flaps 42 and 44. The second pair of cut-outs 76 and 78 as well as the third pair of cut-outs 86 and 88 thus formed serve to minimize dust flap drag between the dust flaps and the adjacent pair of end panels whenever the dust flaps are closed on the carton after the carton has been filled, as will be described more fully hereinafter. The third pair of cut-outs 86 and 88 are sized a pre-determined dimension as shown by the numerals 87 and 89.

A fourth pair of cut-outs 90 and 92 may be formed on the top panel 22 and function in combination with the pair of first cut-outs 66 and 68 to minimize drag between the dust flaps and the end panels whenever the dust flaps are closed on the carton after the carton has been filled. The fourth pair of cut-outs 90 and 92 are sized a predetermined dimension as shown by the numerals 91 and 93.

A pair of fifth cut-outs 94 and 96 as well as a pair of sixth cut-outs 95 and 97 are formed on each end panel 34, 36, 38 and 40 and serve to aid in proper alignment of the end panels whenever the end panels are closed. The fifth and sixth pair of cut-outs are sized a pre-determined dimension as shown by the numerals 99 and 101.

A relief means in the form of a pair of relief cuts 98 and 100 are formed on the top panel along the score lines 54 and 56 between the top panel 22 and the top panel dust flaps 50 and 52. The relief cuts are thereby formed in the area of the double thickness overlap of the top panels 22 and 24 whenever these panels are adhesively secured together and provide relief along the score line aiding in the folding of the dust flaps 50, 52, 58 and 60. (The relief cuts 98 and 100 have been symbolically thickened to emphasize a difference between them and the normal score lines.)

Figure 3:
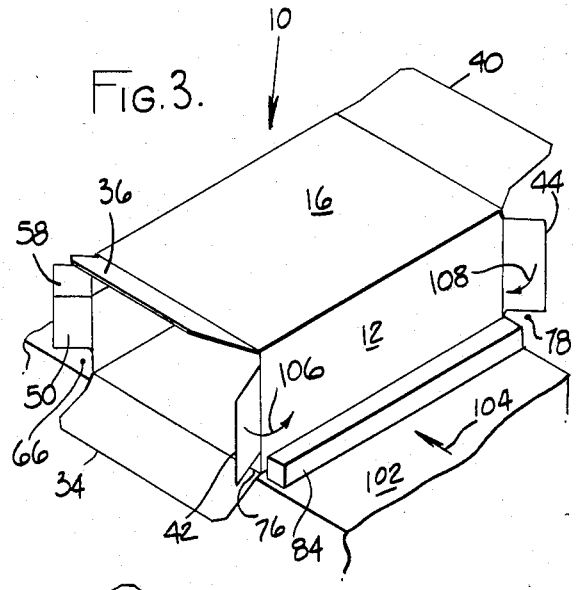
FIG. 3 is a perspective view of the package shown in FIG. 1 showing it positioned on an existing carton filling machine having traveling flight bars and showing the rear traveling flight bar utilized to propel the package through the filling machine.
Figure 4:
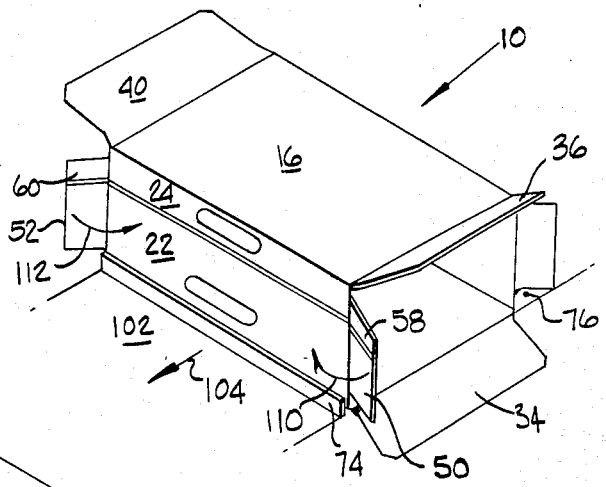
FIG. 4 is a perspective view of the package shown in FIG. 3 showing the front flight bar utilized in the existing filling machine for containing the package on the moving parts of the filling machine.

Referring now to FIGS. 3 and 4 of the drawing, there will be shown in detail the functioning of the various cut-outs hereinbefore described. The carton style filling machine has been shown generally by the numeral 102 in FIGS. 3 and 4 for purposes of clarity and would comprise a plurality of traveling flight bars 74 and 84 traveling in the direction shown by the numeral 104 by means known in the filling machine art. FIG. 3 is a perspective view looking at the rear portion of the carton traveling along the filling line whereas FIG. 4 would be a perspective view looking at the front or top panels of the same carton as it is traveling along the filling line. The flight bar 84 would be utilized to move the carton in the direction shown by the arrow 104 while the flight bar 74 would be used to retain the open sleeve-style carton in the position shown in FIGS. 3 and 4 of the drawings.

Prior to filling cans into the carton 10 on the filling machine, the end panels 34 and 36 along with the end panels 38 and 40 would be turned upwardly and downwardly in the position shown in FIGS. 3 and 4 by turning means forming no part of this invention. In a similar manner, it is necessary to turn the bottom panel dust flaps 42 and 44 in the direction shown by the numerals 106 and 108 so that they will not interfere with insertion of cans into the package. Likewise, the top panel dust flaps 58 and 60 as well as the top panel dust flaps 50 and 52 must be turned in the direction shown by the arrows 110 and 112 so that they will not interfere with insertion of cans into the package.

It can be seen by referring to FIG. 3 that whenever the bottom panel dust flaps 42 and 44 are turned in the direction shown by the arrow 106 and 108 to the position shown in FIG. 3 that the second pair of cut-outs 76 and 78 would serve to allow the dust flaps to clear certain necessary machine parts. In a similar manner, it can be seen in FIG. 4 that the turning of the top panel dust flaps 50 and 58 in the direction shown by the arrow 110 and the turning of the top panel dust flaps 52 and 60 in the direction shown by the arrow 112 would allow the first pair of cut-outs 66 and 68 to operate to permit the top panel dust flaps to clear certain necessary machine parts.

After the plurality of cans have been inserted into the carton 10, the end panels 34 and 36 along with the end panels 38 and 40 will be turned upwardly and downwardly respectively after the dust flaps 42 and 44 along with the dust flaps 50, 58 and 52, 60 have been turned inwardly to be adhesively secured to each other to totally enclose the package. In order to minimize drag between the dust flaps and the end panels whenever the respective flaps and panels are closed on the carton, it can be seen then how the second and third pair of cut-outs 76, 78 and 86 and 88 function to accomplish this on one side of the carton and the first pair of cut-outs 66, 68 along with the fourth pair of cut-outs 90, 92 function to achieve this on the other side of the carton. As a result, the dust flaps and end panels are able to be quickly folded in and adhesively secured to each other after having applied thereto a predetermined amount of adhesive.

As has been before mentioned, there is provided on the end panel 34 and 38 as well as the end panels 36 and 40 a fifth and sixth pair of cut-outs 94, 96 and 95, 97. These cut-outs then serve to aid in the proper alignment of the end panels of the carton whenever the end panels are turned downwardly and upwardly to be adhesively secured to the various dust flaps hereinbefore described. By the use of the fifth and sixth pair of cut-outs which are formed by providing a slight diagonal 114 on the edges of the end panel as shown in FIG. 5 of the drawing, the end panels may be properly aligned when turned and overlapped and adhesively secured to the dust flaps. The fifth and sixth cut-out thereby allows some degree of misalignment of the end panels during the gluing operation resulting from a carton 10 passing through the filling machine 102 and not being truly squared up or formed in a true rectangular end configuration.

Figure 2:
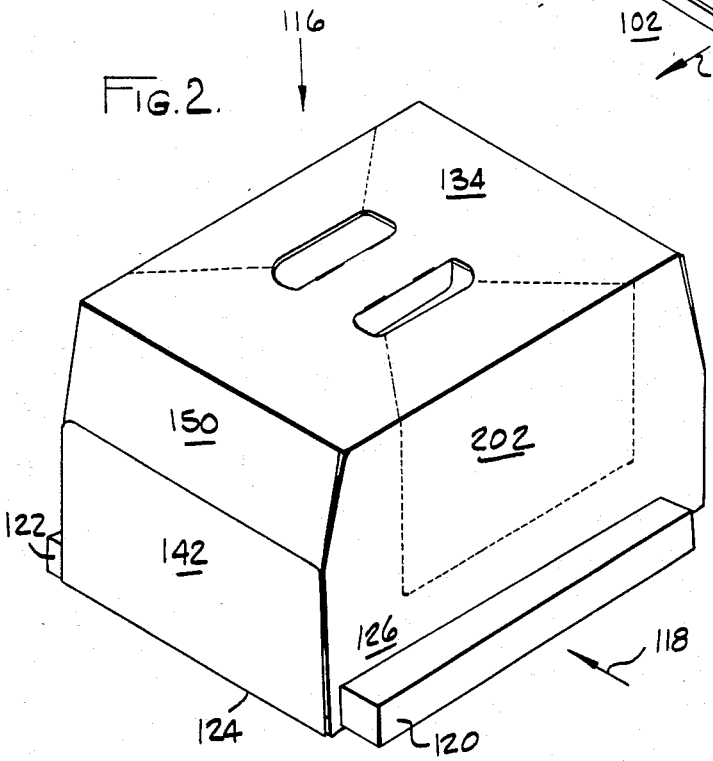
FIG. 2 is a perspective view of a modification of the package shown in FIG. 1 showing the Applicant's improved package utilized in another form.
Figure 6:
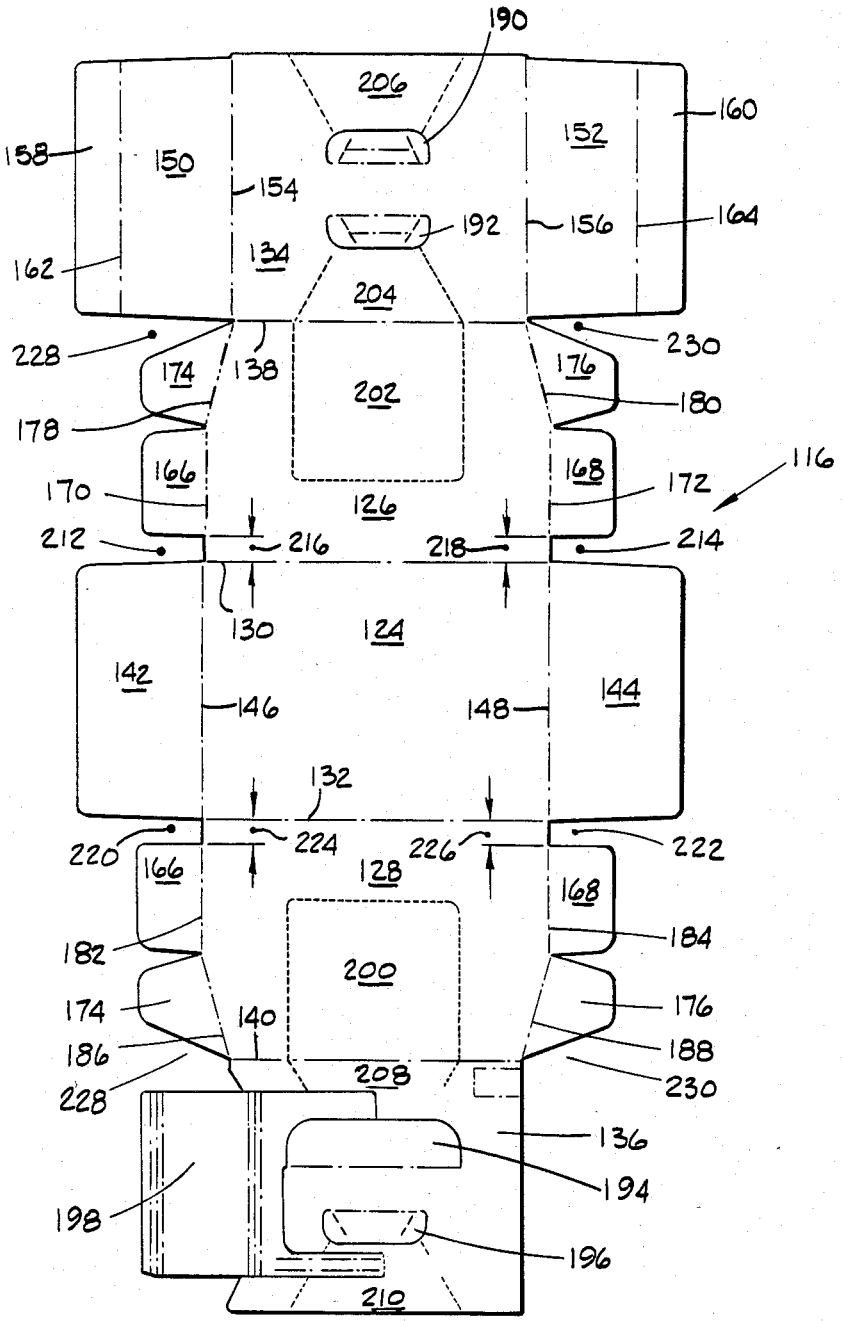
FIG. 6 is a plan view of the production blank for the modification of the package shown in FIG. 2 of the drawings.

Referring now to FIGS. 2 and 6 of the drawing, there will be described in detail the Applicant's basic invention utilized with a different type of carton shown generally by the numeral 116 which is designed to handle 12 bottles of beverage of the 12 ounce size. It should be noted that for purposes of brevity, the folding of the end panels and dust flaps of the carton 116 has not been shown. From a description of the carton hereinafter outlined and from a study of FIG. 6 showing the production blank of the carton, it should become apparent how the cut-outs have been utilized in the carton 116 to accomplish the same purpose as utilized in the carton 110. In traveling through a carton filling machine, the carton 116 would be traveling in the direction shown by the arrows 118 propelled by a flight bar 120 and restrained by a flight bar 122 similar to the flight bars 84 and 74 of the FIGS. 3 and 4 version. In the embodiment shown in FIGS. 2 and 6 of the drawings, there is provided a first pair of cut-outs, a second pair of cut-outs and a third pair of cut-outs formed in the respective dust flaps of the production blank as will be described more fully herein-after. In addition, the carton 116 shown in FIGS. 2 and 6 contains split dust flaps formed as first and second side flaps due to the configuration and sloping sides of the carton as can be seen more clearly in FIG. 2 of the drawing.

Referring now to FIGS. 2 and 6 of the drawing, there is shown a carton generally by the numeral 116 which comprises a bottom panel 124 having hingedly attached thereto on opposite sides thereof a pair of side panels 126 and 128 by means of the score line 130 and 132. A top panel 134 and 136 is hingedly connected to opposite sides of the side panels 126 and 128 by means of the score lines 138 and 140. The top panel 136 would be laminated to the top panel 134 with the top panel 134 being an outer panel and the top panel 136 being an inner panel.

A pair of end panels 142 and 144 are hingedly attached to the bottom panel 124 by means of the score lines 146 and 148. In a similar manner, a pair of end panels 150 and 152 are hingedly attached to the outer top panel 134 by means of the score lines 154 and 156. The end panels 150 and 152 contain glue flaps 158 and 160 hingedly attached thereto by means of the score lines 162 and 164. In the formation of the carton 116 from the production blank shown in FIG. 6 to the erected carton shown in FIG. 2, it should become apparent then that the glue flaps 158 and 160 would be overlapped and glued to the end panels 142 and 144 to provide the completely enclosed carton shown in FIG. 2.

The side panel 126 contains a pair of first side panel dust flaps 166 and 168 hingedly attached thereto by means of the score lines 170 and 172. The side panel 126 also contains a pair of second side panel dust flaps 174 and 176 hingedly attached thereto by means of the score lines 178 and 180.

In a similar manner, the side panel 128 contains a pair of first panel dust flaps 166 and 168 and a pair of second side panel dust flaps 174 and 176 hingedly attached thereto by means of the score lines 182, 184, 186 and 188.

The outer top panel 134 also contains handle means in the form of a pair of handle openings 190 and 192 which are positioned to be adjacent to the handle openings 194 and 196 formed in the inner top panel 136. The inner top panel 136 also contains a drop down partition 198 designed to be positioned within the interior of the carton 116 between adjacent bottles contained within the package. A tear-out panel 200 is formed in the side panel 128 and a tear-out panel 202 is formed in the side panel 126 as is known in the art. A tear-out panel 204 and 206 are formed in the outer top panel 134 and are designed to lie adjacent to the tear-out panels 208 and 210 formed on the inner top panel 136.

A first cut-out 212 and 214 is formed in at least one pair of dust flaps and is sized a predetermined distance shown by the arrow 216 and 218 to provide a cut-out area so that the dust flaps 166 and 168 can be revolved during the filling operation to clear the traveling flight bars in a manner similar to that detailed when referring to FIGS. 1, 3 and 4. In a similar manner, a second cut-out 220 and 222 is formed in the dust flaps 166 and 168 and is sized a predetermined distance shown by the numerals 224 and 226 to provide a cut-out area so that these dust flaps can also be revolved during the filling operation to clear the traveling flight bar.

The second dust flaps 174 and 176 contained on the side panels 126 and 128 also contain a third pair of cut-outs 228 and 230 which function in combination with the second cut-outs 212 and 224 and 220 and 222 formed on the dust flaps 166 and 168 to minimize drag between the dust flaps and the end panels whenever the dust flaps are closed on the carton after the carton has been filled.

From the foregoing, it can be seen that there has been provided by the subject invention a new and improved sleeve-style beverage carton which may be utilized in several forms and which is designed to obviate problems encountered with the use of dust flap type sleeve-style cartons in existing carton filling machines. It should be apparent that many changes may be made in the various carton structure and configuration as well as the arrangement of the various parts of the carton without departing from the spirit and scope of the invention. The preferred embodiment shown and modification shown have been given by way of illustration only.

Having described my invention, I claim:

1. A paperboard sleeve-style beverage carton for use on a carton filling machine having traveling flight bars, comprising:

(a) a bottom panel;

(b) a pair of side panels, hingedly connected to opposite sides of the bottom panel;

(c) a first top panel and a second top panel hingedly connected to opposite sides of the side panels, the top panels being overlapped and adhesively secured together, and the top panels having handle means for lifting the carton;

(d) a pair of end panels hingedly connected to opposite ends of each of the side panels, each end panel having an upper and a lower cutout whereby the heights of the end panels are less than the heights of the side panels and the upper and lower edges of each end panel are spaced from the top and bottom panels respectively;

(e) a pair of bottom panel dust flaps hingedly connected to opposite ends of the bottom panel, each bottom panel dust flap having a first bottom panel dust flap cutout on one side and a second bottom panel dust flap cutout on the other side with the first bottom panel dust flap cutouts being larger than the second bottom panel dust flap cutouts whereby the widths of the bottom panel dust flaps are less than the width of the bottom panel, the side edges of the bottom panel dust flaps are spaced from the side panels and the dust flaps can be revolved to extend outwardly from the bottom panel during the filling operation;

(f) a pair of first top panel dust flaps hingedly connected to opposite ends of the first top panel, each first top panel dust flap having a cutout on a side adjacent the side panel, the cutouts being substantially the same size as the first bottom panel dust flap cutouts whereby the widths of the first top panel dust flaps are less than the width of the first top panel, the side edges of the first top panel dust flaps are spaced from the side panels and the first top panel dust flaps can be revolved to extend outwardly from the first top panel during the filling operation;

(g) a pair of second top panel dust flaps hingedly connected to opposite ends of the second top panel, each second top panel dust flap having a cutout on a side adjacent the side panel, the cutouts being substantially the same size as the second bottom panel dust flap cutouts whereby the widths of the second top panel dust flaps are less than the width of the second top panel and the side edges of the second top panel dust flaps are spaced from the side panels; and (h) relief means on the hinged connections between at least one of the first and second top panel dust flaps and the respective top panel to aid in the folding of the first and second top panel dust flaps.

2. A paperboard production blank for sleeve-style beverage carton for use on a carton filling machine having traveling flight bars, comprising:

(a) a bottom panel;

(b) a pair of side panels, hingedly connected to opposite sides of the bottom panel;

(c) a first top panel and a second top panel hingedly connected to opposite sides of the side panels, the top panels adapted to be overlapped and adhesively secured together, and the top panels having handle means for lifting the carton;

(d) a pair of end panels hingedly connected to opposite ends of each of the side panels, each end panel having an upper and a lower cutout whereby the height of the end panels are less than the heights of the side panels and the upper and lower edges of each end panel are spaced from the top and bottom panels respectively when the carton is formed;

(e) a pair of bottom panel dust flaps hingedly connected to opposite ends of the bottom panel, each bottom panel dust flap having a first bottom panel dust flap cutout on one side and a second bottom panel dust flap cutout on the other side with the first bottom panel dust flap cutouts being larger than the second bottom panel dust flap cutouts whereby the widths of the bottom panel dust flaps are less than the width of the bottom panel, the side edges of the bottom panel dust flaps are spaced from the side panels when the carton is formed and the dust flaps can be revolved to extend outwardly from the bottom panel during the filling operation;

(f) a pair of first top panel dust flaps hingedly connected to opposite ends of the first top panel, each first top panel dust flap having a cutout on a side adjacent the side panel, the cutouts being substantially the same size as the first bottom panel dust flap cutouts whereby the widths of the first top panel dust flaps are less than the width of the first top panel, the side edges of the first top panel dust flaps are spaced from the side panels when the carton is formed and the first top panel dust flaps can be revolved to extend outwardly from the first top panel during the filling operation;

(g) a pair of second top panel dust flaps hingedly connected to opposite ends of the second top panel, each second top panel dust flap having a cutout on a side adjacent the side panel, the cutouts being substantially the same size as the second bottom panel dust flap cutouts whereby the widths of the second top panel dust flaps are less than the width of the second top panel and the side edges of the second top panel dust flaps are spaced from the side panels when the carton is formed;

and (h) relief means on the hinged connections between at least one of the first and second top panel dust flaps and the respective top panel to aid in the folding of the first and second panel dust flaps.

* * * * *